US007431025B2

(12) United States Patent
Cianciara et al.

(10) Patent No.: US 7,431,025 B2
(45) Date of Patent: Oct. 7, 2008

(54) DEVICE FOR THE OPERATION OF AN INTERNAL COMBUSTION ENGINE

(75) Inventors: Wojciech Cianciara, Probstberg (DE); Gerd Rösel, Regensburg (DE)

(73) Assignee: Siemens Aktiengellschaft, Muenchen (DE)

( * ) Notice: Subject to any disclaimer, the term of this patent is extended or adjusted under 35 U.S.C. 154(b) by 0 days.

(21) Appl. No.: 11/791,690

(22) PCT Filed: Jul. 14, 2006

(86) PCT No.: PCT/EP2006/064256

§ 371 (c)(1),
(2), (4) Date: May 24, 2007

(87) PCT Pub. No.: WO2007/036375

PCT Pub. Date: Apr. 5, 2007

(65) Prior Publication Data

US 2008/0022987 A1 Jan. 31, 2008

(30) Foreign Application Priority Data

Sep. 26, 2005 (DE) ..... 10 2005 045 888

(51) Int. Cl.
*F02D 41/14* (2006.01)

(52) U.S. Cl. ..... 123/696; 701/109; 701/114; 73/114.72

(58) Field of Classification Search ..... 701/114, 701/115, 106, 109; 123/695, 696; 73/118.02, 73/116.02, 116.03, 116.04, 114.72, 114.73
See application file for complete search history.

(56) References Cited

U.S. PATENT DOCUMENTS 5,050,563 A * 9/1991 Kohler ..... 123/682

(Continued)

FOREIGN PATENT DOCUMENTS

DE 19606652 A1 8/1997

(Continued)

OTHER PUBLICATIONS

Herausgeber Richard Von Basshuysen and Fred Schäfer, "Handbuch Verbrennungsmotor" zweite Auflage, Jun. 2004, p. 559, Friedrich Vieweg & Sohn Verlagsgesellschaft mbH Braunschweig/Wiesbaden, Seite 559, ["Manual, Internal Combustion Engine", Publisher Richard von Basshuysen, Fred Schäfer, Second Edition, Jun. 2004, Friedrich Vieweg & Sohn Publishing House GmbH Braunschweig/Wiesbaden,].

*Primary Examiner*—Willis R. Wolfe, Jr.
*Assistant Examiner*—Johnny H. Hoang
(74) *Attorney, Agent, or Firm*—Bell, Boyd & Lloyd LLP

(57) ABSTRACT

Disclosed is an internal combustion engine comprising at least one cylinder and an exhaust manifold in which a catalytic converter, a first exhaust gas probe, and a second exhaust gas probe are disposed. The first exhaust probe is located upstream from the catalytic converter while the second exhaust gas probe is arranged downstream therefrom. A lambda Controller is provided which is configured so as to determine a lambda correction factor in accordance with a first test signal that is assigned to the first exhaust gas probe. A trim controller is provided to which a setpoint value and an actual value of a second test signal allocated to the second exhaust gas probe are fed as a control difference. The trim controller is configured so as to determine a proportionate corrective factor. A control signal unit is embodied so as to determine a control signal for apportioning fuel into the cylinder in accordance with the lambda correction factor and additionally determine the control signal for apportioning fuel into the cylinder according to the proportionate corrective factor in a diagnostic mode of a component associated with the exhaust manifold.

20 Claims, 2 Drawing Sheets

U.S. PATENT DOCUMENTS

| | | | | |
|---|---|---|---|---|
| 5,265,416 | A | 11/1993 | Hamburg et al. | |
| 5,307,625 | A * | 5/1994 | Junginger et al. | 60/274 |
| 5,317,868 | A * | 6/1994 | Blischke et al. | 60/274 |
| 5,787,867 | A * | 8/1998 | Schnaibel et al. | 123/674 |
| 6,131,446 | A * | 10/2000 | Schnaibel et al. | 73/114.73 |
| 6,245,205 | B1 * | 6/2001 | Schnaibel et al. | 204/401 |
| 6,287,453 | B1 | 9/2001 | Rosel et al. | |
| 6,382,199 | B2 * | 5/2002 | Nusser et al. | 123/690 |
| 7,017,402 | B2 * | 3/2006 | Kagleder | 73/114.39 |
| 7,131,261 | B2 * | 11/2006 | Wackerow et al. | 60/277 |
| 2003/0221415 | A1 | 12/2003 | Rösel et al. | |
| 2007/0244621 | A1 * | 10/2007 | Rosel et al. | 701/101 |

FOREIGN PATENT DOCUMENTS

| | | | |
|---|---|---|---|
| DE | 10223554 | C1 | 8/2003 |
| DE | 10307010 | B3 | 5/2004 |
| DE | 102004033325 | A1 | 2/2005 |
| DE | 102004006992 | A1 | 9/2005 |
| EP | 0952322 | A2 | 10/1999 |

* cited by examiner

DEVICE FOR THE OPERATION OF AN INTERNAL COMBUSTION ENGINE

CROSS REFERENCE TO RELATED APPLICATIONS

This application is the US National Stage of International Application No. PCT/EP2006/064256, filed Jul. 14, 2006 and claims the benefit thereof. The International Application claims the benefits of German application No. 10 2005 045 888.2 DE filed Sep. 26, 2005, both of the applications are incorporated by reference herein in their entirety.

FIELD OF INVENTION

The invention relates to a device for the operation of an internal combustion engine.

BACKGROUND OF INVENTION

Bearing in mind the increasingly strict statutory regulations, it has on the one hand become necessary in the case of internal combustion engines, to keep the exhaust gas emissions ahead of the catalytic converter as low as possible, i.e. to reduce the pollutant emissions, which arise during the combustion of the air-to-fuel mixture in the cylinders. On the other hand, exhaust gas aftertreatment systems are used in internal combustion engines, which convert the pollutant emissions which are generated during the combustion process of the air-to-fuel mixture in the relevant cylinders, into harmless substances. For this reason, in particular in the case of spark ignition engines, three-way catalytic converters are used as exhaust gas catalytic converters. A high degree of efficiency when converting the pollutant components, which are carbon monoxides, hydrocarbons or even nitrogen oxides, requires a very accurately adjusted air-to-fuel ratio in the cylinders and, in addition, the mixture must show a specified fluctuation upstream of the exhaust gas catalytic converter, i.e. a purposeful operation of the internal combustion engine is necessary both in the excess air and in the oxygen shortage in order to ensure that the oxygen storage unit of the exhaust gas catalytic converter is filled and emptied. On storing the oxygen, especially the nitrogen oxides are reduced whereas, on emptying, the oxidation is supported and it is in addition prevented that stored oxygen molecules deactivate the partial ranges of the exhaust gas catalytic converter.

A lambda control for an internal combustion engine with an exhaust gas probe, which is embodied as a binary lambda probe and which is arranged upstream of an exhaust gas catalytic converter in an exhaust gas tract of an internal combustion engine is known from the specialist book, "Handbuch Verbrennungsmotor", Herausgeber Richard von Basshuysen/Fred Schäfer, zweite Auflage, June 2004, Friedrich Vieweg & Sohn Verlagsgesellschaft mbH Braunschweig/Wiesbaden, Seite 559, ["Manual, Internal Combustion Engine", Publisher Richard von Basshuysen, Fred Schäfer, Second Edition, June 2004, Friedrich Vieweg & Sohn Publishing House GmbH Braunschweig/Wiesbaden, Page 559]. Moreover, provision has also been made for an additional exhaust gas probe to be arranged downstream of the exhaust gas catalytic converter. The lambda control includes a PI controller in which case the P parts and the I parts are stored in performance graphs relating to the rotational speed of the engine and the load. An excitation of the exhaust gas catalytic converter, and the lambda fluctuation, results from the two-point control on the basis of the binary measurement signal of the upstream lambda probe. The control is embodied in such a way that the amplitude of the lambda fluctuations are set at approximately 3%. For a better observance of a lambda window ahead of the exhaust gas catalytic converter, provision has been made for a trim control superimposed over a post-catalytic converter probe.

The reason for making provision for a trim control is that exhaust gas probes, in particular those that have been arranged upstream of the exhaust gas catalytic converter, change their response behavior as the air-to-fuel ratio changes during its period of operation. This leads to the fact that, with the aid of the measurement signal of the exhaust gas probe, changes in the air-to-fuel ratio can be identified either sooner or later. In particular, the response behavior of the exhaust gas probe may also change asymmetrically in the case of jumps in its measurement signal from a rich value to a lean value and vice versa. The lean value adopts the measurement signal of the binary lambda probe if the air-to-fuel ratio exceeds a stoichiometric air-to-fuel ratio. The measurement signal of the binary lambda probe has a rich value if the air-to-fuel ratio exceeds a stoichiometric air-to-fuel ratio, with the ratios being related in each case to the composition of the mixture before the oxidation of the fuel.

If the lambda control is not adjusted to the changed response behavior of the exhaust gas probe, this may lead to higher pollutant emissions of the internal combustion engine because of a sharply reduced conversion of pollutant emissions into harmless substances. This is why the trim control intervenes.

In order to ensure that correspondingly predetermined maximum pollutant emissions are not exceeded, the diagnosis of components of the exhaust gas tract of the internal combustion engine is often controlled by legal regulations. Thus for example an oxygen storage capacity of the exhaust gas catalytic converter must be diagnosed.

For diagnosing the exhaust gas catalytic converter, it is known from DE 103 07 010 B3 that, as soon as a change from a rich fuel mixture to a lean fuel mixture has been detected during a lean half-period, the lambda control factor must first of all be kept constant for a delay time and in order to be able to make it leaner by a proportionate jump after the delay time. The maximum value of the lambda control factor is maintained until a defined oxygen load has been reached in this control cycle. The specific oxygen load, which is used for carrying out the catalytic converter efficiency diagnosis, corresponds with the oxygen storage capacity of an aged catalytic converter, which still meets the requirements that have been prescribed. The diagnosis of the efficiency takes place with the aid of a lambda monitor probe, which is arranged in the exhaust gas flow just after the exhaust gas catalytic converter. The monitor probe detects whether or not a constant lambda value has been reached or whether or not the lambda value fluctuates in accordance with the control cycles. Should the lambda value measured by the monitor probe fluctuate, then the tested catalytic converter no longer has a sufficient oxygen storage capacity and a defective or aged catalytic converter is identified.

SUMMARY OF INVENTION

An object of the invention is to create a device for the operation of an internal combustion engine which ensures an operation of the internal combustion engine with very low pollutant emissions.

The object is achieved by the features of the independent claims. Advantageous embodiments of the invention emerge from the subclaims.

The invention is characterized by a device for the operation of an internal combustion engine comprising at least one cylinder and an exhaust gas tract in which an exhaust gas catalytic converter and a first exhaust gas probe are arranged upstream of the exhaust gas catalytic converter and a second exhaust gas probe is arranged downstream of an exhaust gas catalytic converter. The device comprises a lambda controller, which is configured so as to determine a lambda correction factor in accordance with a first measurement signal that is assigned to the first exhaust gas probe. A trim controller is provided to which a setpoint value and an actual value of a second measurement signal allocated to the second exhaust gas probe are fed as a control difference. The first exhaust gas probe preferably is a binary exhaust gas probe, however, said probe can also be a linear exhaust gas probe in principle. It is particularly easy if the second exhaust gas probe is a binary exhaust gas probe, however, said probe can also in principle be a linear exhaust gas probe.

In addition, provision has been made for a control signal unit in which case said unit is embodied so as to determine a control signal for apportioning fuel into the cylinder as a function of the lambda correction factor and so as to determine, in addition, the control signal for apportioning fuel into the cylinder as a function of the proportionate corrective factor in a diagnostic operating state of a component associated with the exhaust gas tract. The components associated with the exhaust gas tract can for example be the exhaust gas catalytic converter, the first exhaust gas probe, the second exhaust gas probe or even an additional component. Because the control signal in the control signal unit in the diagnostic operating state is also determined as a function of the proportionate corrective factor, a very rapid access by the trim controller on the fuel to be dispensed is guaranteed. This leads, in particular in the case of relatively long control cycles, especially as they occur during the diagnosis and here, in particular, together with the use of a binary first exhaust gas probe, to significantly reduced pollutant emissions during a diagnosis. Above and beyond this, it has surprisingly been proven that in this way too the diagnosis can carried with much greater precision.

According to an advantageous embodiment, the device comprises a low-pass filter to filter the actual value of the second measurement signal and to feed the filtered actual value of the second measurement signal to the trim controller to form the control difference in the diagnostic operating state of a component associated with the exhaust gas tract. In this way, in particular in the case of a suitable selection of a variable representing the cut-off frequency of the low-pass filter, and a very good decoupling of the trim controller from the diagnosis to be made can be guaranteed. In this way the diagnosis can then be carried our particularly precisely and, on the other hand, very precise changes in the response behavior of the first exhaust gas probe can be compensated for by the trim controller.

It is particularly advantageous if the diagnostic operating state of a component assigned to the exhaust gas tract is a diagnostic operating state of the exhaust gas catalytic converter.

BRIEF DESCRIPTION OF THE DRAWINGS

The invention is described in more detail below with reference to the exemplary embodiment specified in the figures of the drawing. They are as follows.

DETAILED DESCRIPTION OF INVENTION

Figure 1:
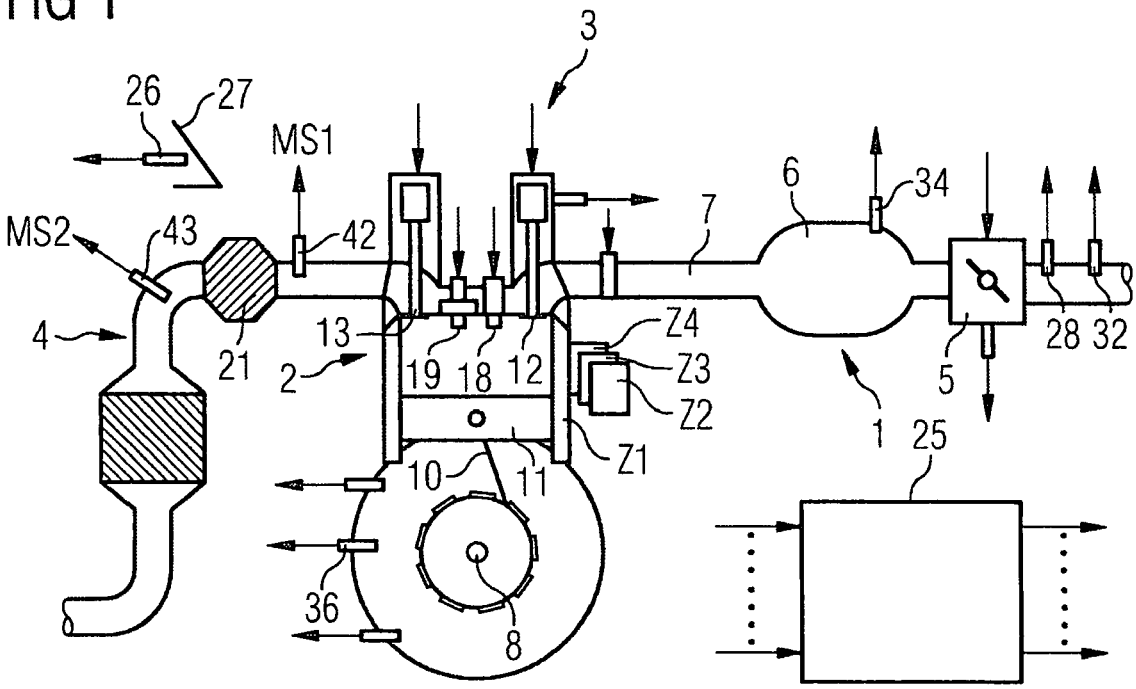
FIG. 1 an internal combustion engine with a control device.

An internal combustion engine (FIG. 1) comprises an intake tract 1, an engine block 2, a cylinder head 3, and an exhaust gas tract 4. The intake tract 1 preferably comprises a throttle valve 5, also a manifold 6 and an intake pipe 7, which is guided to a cylinder Z1 via an intake port in an engine block 2. The engine block 2 also comprises a crankshaft 8 that is connected to piston 11 of a cylinder Z1 by means of a connecting rod 10.

The cylinder head 3 includes a valve drive with a gas intake valve 12 and a gas discharge valve 13. The cylinder head 3 also includes both an injection valve 18 and a spark plug 19. Alternatively, the injection valve 18 can also be arranged in the intake pipe 7.

An exhaust gas catalytic converter 21 is arranged in the exhaust gas tract, said catalytic converter being embodied as a three-way catalytic converter. Moreover, an additional exhaust gas catalytic converter is preferably arranged in the exhaust gas tract, which is embodied as an NOx catalytic converter.

A control device 25 is provided to which sensors are assigned, said sensors detecting the different measured quantities and in each case determining the value of the measured quantity. The control device 25 determines, in accordance with at least one of the measured quantities, controlling variables, which are then converted into one or more adjusting signals for controlling the final control elements by means of corresponding actuators. The control device 25 can also be referred to as a device for operating an internal combustion engine.

The sensors are a pedal position indicator 26 which detects the position of an acceleration pedal 27, an air mass flow meter 28 which detects an air mass flow upstream of the throttle valve 5, a temperature sensor 32 which detects an intake air temperature, an intake pipe pressure sensor 34 which detects the intake pipe pressure in a manifold 6, a crankshaft angle sensor 36 which detects a crankshaft angle to which a rotational speed N is allocated.

Moreover, provision has been made for a first exhaust gas probe 42, which is arranged upstream of the exhaust gas catalytic converter 21 and which records a residual oxygen content of the exhaust gas and the measurement signal MS1 of which is characteristic of the air-to-fuel ratio in the combustion chamber of a cylinder Z1 and upstream of the first exhaust gas probe 42 ahead of the oxidation of the fuel, referred to below as the air-to-fuel ratio in the cylinders Z1-Z4. Moreover, provision has been made for a second exhaust gas probe 43, which is arranged downstream of the exhaust gas catalytic converter 21 and which records a residual oxygen content of the exhaust gas and the measurement signal of which, and no doubt the actual value MS2 of the measurement signal, is characteristic of the air-to-fuel ratio in the combustion chamber of a cylinder Z1 and upstream of the second exhaust gas probe 43 ahead of the oxidation of the fuel, referred to below as the air-to fuel ratio downstream of the exhaust gas catalytic converter.

The first exhaust gas probe 42 is preferably a binary lambda probe. The second exhaust gas probe 43 is preferably a binary lambda probe. However, the first and/or the second exhaust gas probe can also be a linear lambda probe in principle.

According to the embodiment of the invention, there can be any subset of the mentioned sensors or there can even be additional sensors.

The final control elements are, for example, the throttle valve 5, the gas intake, and the gas discharge valves 12, 13, the injection valve 18 or the spark plug 19.

In addition to the cylinder Z1, further cylinders Z2 to Z4 are preferably provided, to which corresponding final control elements and, if required, sensors are also assigned.

Figure 2:
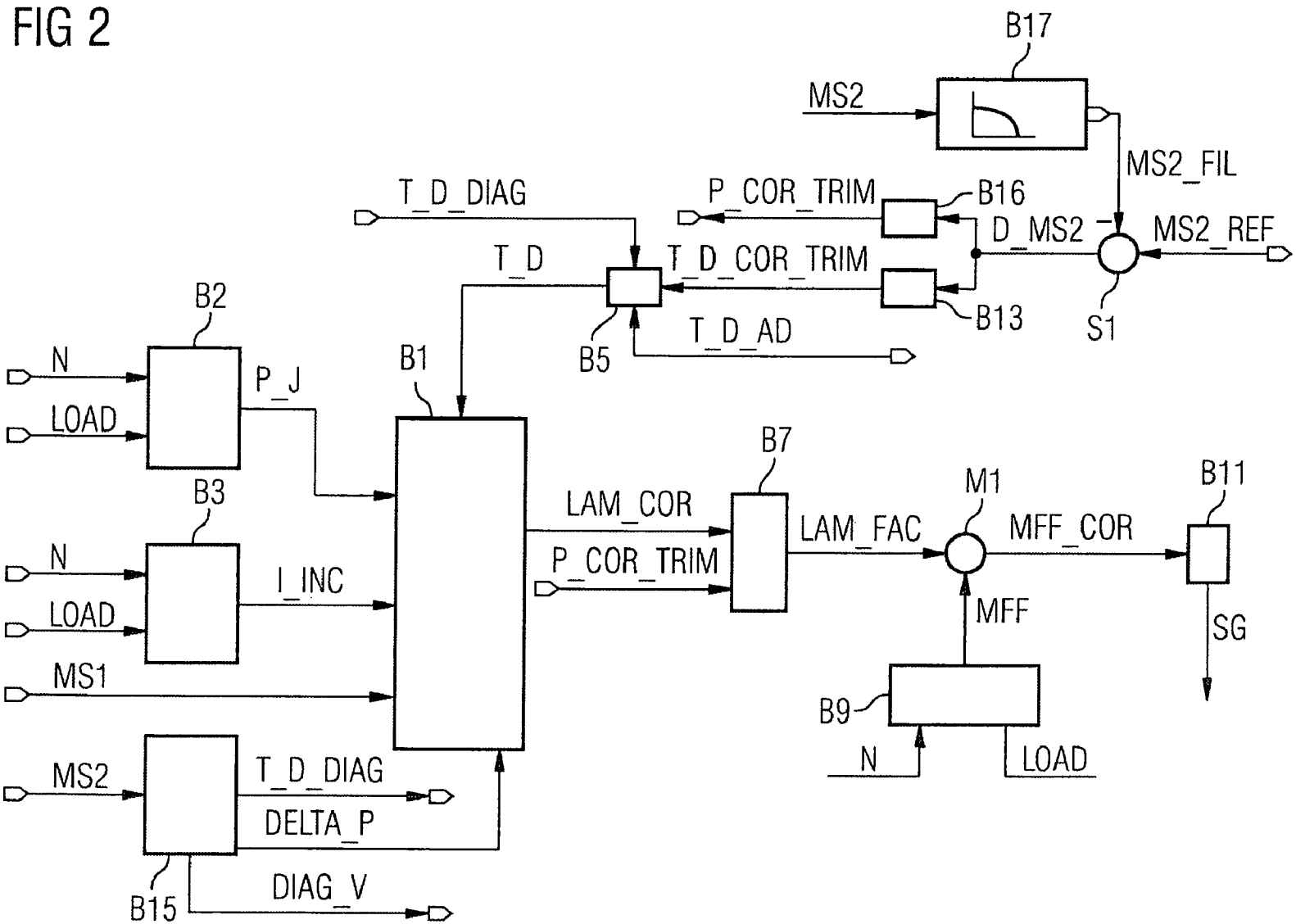
FIG. 2 a block diagram of a part of the control device.

A part of the control device 25 is shown in greater detail with the aid of the block diagram in FIG. 2. A block B1 includes a lambda controller. The lambda controller is fed to the first measurement signal MS1 in the form of a control variable. The measurement signal MS1 is of a binary nature in a preferred manner, i.e. it adopts a lean value if the air-to-fuel ratio before of the exhaust gas catalytic converter 21 is lean and a rich value if it is too rich. Only in a very small intermediate range, it also adopts intermediate values between the lean value and the rich value. Because of the binary nature of the first measurement signal MS1, the lambda controller is embodied in the form of a two-point controller. The lambda controller is preferably configured in the form of a PI controller. A P part is preferably fed in the form of a proportionate jump P_J to a block B1. Provision has been made for a block B2, in which the proportionate jump P_J is determined as a function of the rotational speed N and a load variable LOAD. To this end, provision has preferably been made for a performance graph which can be stored permanently.

An I part of the lambda controller is preferably determined as a function of an integral increment I_INC. The integral increment I_INC is also preferably determined in a block B3 as a function of the rotational speed and a load variable. To this end, a performance graph can likewise be provided as an example. The load variable LOAD can for example be an air mass flow or even the intake pipe pressure.

In addition, provision has also been made for a delay time duration T_D in the form of an input parameter for a block B1 that is determined in a block B5, which is described in more detail below.

A lambda correction factor LAM_COR is present on the output side of the lambda controller.

Figure 3:
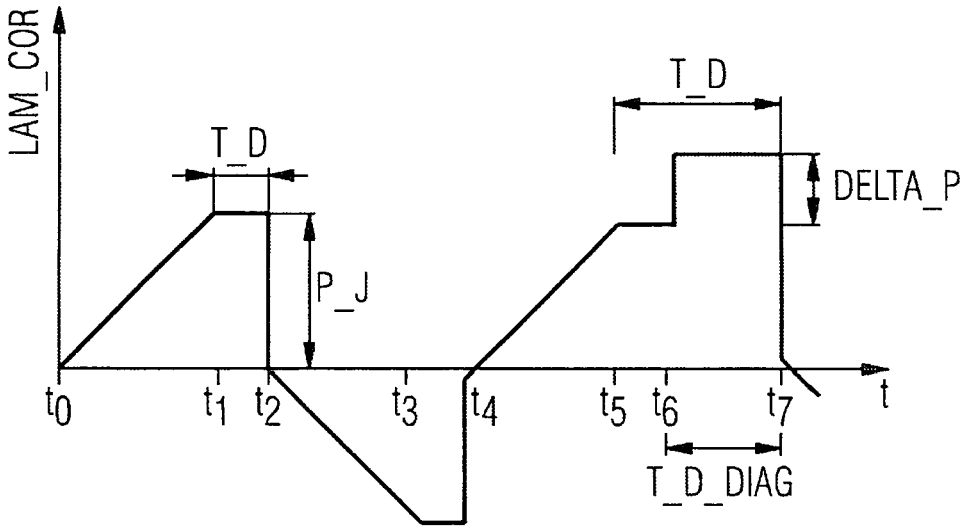
FIG. 3 a signal curve.

The mode of operation of the lambda controller in block B1 is for example explained in greater detail with the aid of FIG. 3. At a point in time t0, the lambda correction factor LAM_COR has a neutral value, e.g. 1, and is incremented starting from the point in time t0 up to a point in time t1 as a function of the integral increment I_INC. This, for example, occurs in a specified time pattern, in which the current value of the lambda correction factor LAM_COR is incremented in each case by the integral increment I_INC. The point in time t1 is characterized in that the first measurement signal MS1 jumps from its lean value to its rich value.

If it is found that the first measurement signal MS1 has jumped from its lean value to the rich value, then the lambda correction factor LAM_COR will not be incremented further by the integral increment I_INC, but will maintain its value for the delay time duration T_D. When the delay time duration T_D expires, which is the case at a point in time t2, the lambda correction factor is reduced according to the proportionate jump P_J. After the jump in the lambda correction factor LAM_COR at the point in time t2, the lambda correction factor LAM_COR is then reduced by the integral increment I_INC and, no doubt, at a rate specified by the integral increment I_INC in a preferred manner until the first measurement signal MS1 makes a jump from the rich value to the lean value, which is the case at a point in time t3. Starting at a point in time t3, the lambda correction factor LAM_COR maintains its value for the specified delay time duration T_D, before it is then again incremented by the proportionate jump P_J when the delay time duration T_D expires at a point in time t4. Subsequently, an incrementing of the lambda correction factor LAM_COR is again carried out as a function of the integral increment I_INC. In principle, this mode of operation of the lambda controller is independent of whether or not a diagnostic operating state of a component associated with the exhaust gas tract is adopted.

A control signal unit is formed by the blocks B7, B9, B11 and a multiplication point M1. The control signal unit is embodied as a function of the lambda correction factor LAM_COR so as to determine a control signal SG for dispensing fuel to the relevant cylinders Z1 to Z4. The injection valve 18 is preferably activated By means of the control signal SG.

In block B7 a lambda control factor LAM_FAC is determined as a function of the lambda correction factor LAM_COR. For example, in an operating condition outside the diagnosis of a component assigned to the exhaust gas tract the lambda correction factor LAM_COR is directly assigned to the lambda control factor LAM_FAC. In a multiplication point M1, a corrected amount of fuel MMF_COR to be dispensed is determined by multiplying the lambda control factor LAM_FAC with an amount of fuel MFF to be dispensed. The amount of fuel to be dispensed is preferably determined in a block B9 as a function of the rotational speed N and the load variable LOAD. This can for example be done with the aid of a performance graph that is preferably stored permanently. In block B11, the control signal SG is determined as a function of the corrected amount of fuel MMF_COR to be dispensed. To this end, it is for example possible in block B11 to determine an injection period and the control signal accordingly to dispense fuel through the injection valve for the duration of the injection.

A trim controller includes the blocks B13 and B15. A block B17 provided, to the input of which is an actual value MS2 of the second measurement signal is applied. Block B17 includes a low-pass filter to filter the actual value MS2 of the second measurement signal and in this way a filtered actual value MS2_FIL of the second measurement signal is generated. A reference MS2_REF of the second measurement signal forms the setpoint value of the second measurement signal. In a summing point S1, a control difference DMS2 of the trim controller is determined by forming a difference between the reference MS2_REF and the actual value MS2_FIL of the second measurement signal. In this way, the reference MS2_REF forms the setpoint value of the second measurement signal. The actual value MS2 of the second measurement signal is preferably filtered by taking a moving average, in which case, preferably for filtering, each new actual value MS2 of the second measurement signal is weighted with approximately 10%, whereas the old filtered actual value MS2_FIL is weighted with approximately 90%. Taking a moving average allows a low-pass filter can be implemented especially simply. Depending on the control difference D_MS2, especially depending on an integral across the control difference, block B13 is configured so as to determine a trim delay time duration factor T_D_COR_TRIM. In a block B5, as a function of the trim delay time duration factor T_D_COR_TRIM and, if required, an adaptation delay time duration factor T_D_AD and, if required, a diagnosis delay time duration factor T_D_DIAG, the delay time duration T_D is then preferably determined by adding up the corresponding factors. The adaptation delay time duration factor T_D_AD is preferably determined as a function of the trim delay time duration factor T_D_DIAG. This preferably takes place outside the operating state of catalytic converter diagnosis. However, this can also basically be carried out during the diagnosis of a component of the exhaust gas tract.

The diagnosis delay time duration factor T_D_DIAG is determined in a block B15, which is embodied to carry out a diagnosis of a component assigned to the exhaust gas tract.

The component can for example be the exhaust gas catalytic converter 21. However, it can also for example be the first exhaust gas probe 42 or the second exhaust gas probe 43. In order to diagnose the exhaust gas catalytic converter 21, in block B15, the diagnosis delay time duration factor T_D_DIAG and preferably a diagnosis proportionate jump factor DELTA_P are determined. This takes place in such a way that by loading the lambda controller with the diagnosis delay time duration factor T_D_DIAG and the diagnosis proportionate jump factor DELTA_P, it can be checked whether or not the exhaust gas catalytic converter 21 has an oxygen storage capability, which an aged exhaust gas catalytic converter that is just within the permissible limiting values has.

Additionally applying the diagnosis delay time duration factor T_D_DIAG to the lambda controller within the framework of the diagnosis results in a marked lengthening of the control cycles of the lambda controller, as can be seen in FIG. 3. At a point in time t5, the first measurement signal MS1 jumps from its lean value to its rich value. A length of time between the points in time t5 and t6 corresponds to the delay time duration T_D outside the diagnostic operating state of the exhaust gas catalytic converter. During the diagnostic operating state, the delay time duration T_D is extended by the diagnosis delay time duration factor T_D_DIAG. In this way, a greater extent of the margin of fluctuation of the oxygen load degree of the exhaust gas catalytic converter 21 is achieved. During the delay time duration T_D, a jump in the lambda correction factor LAM_COR can also take place in a diagnostic operating state according to the diagnostic proportionate jump factor DELTA_P. Also by using this measure, the specified oxygen load can be set properly during the diagnosis. Preferably a characteristic curve of the second measurement signal, in fact its actual value, is stored in the control device 25 as a reference curve by conducting suitable tests with a suitably aged exhaust gas catalytic converter, on an engine test bench for example.

During the diagnosis, the actual value MS2 of the second measurement signal is then compared to the reference curve in block B15 and a quality factor is determined as a function of this comparison, which is then representative of the deviation from the actual value MS2 of the second measurement signal and the reference curve. It is for example possible in this case, to integrate the difference between the actual value MS2 and the reference curve and, if required, it can also be normalized. Depending on this quality factor, a diagnostic value DIAG V is then determined in a block B15. This can for example be done by repeatedly determining the quality factor in different control cycles, in doing so, for example, in 20 cycles, and by adding the quality factors and subsequently comparing them to a specified threshold value, which is specified in such a way that, for example, on exceeding the threshold value, the oxygen storage capability of the exhaust gas catalytic converter 21 will no longer correspond to that of the limiting catalytic converter, i.e. drops below the minimum value.

In block B16, which forms the P part of the trim controller, a proportionate corrective factor P_COR_TRIM is determined as a function of the control difference DMS2 of the trim controller. The proportionate corrective factor P_COR_TRIM is in proportion to the control difference DMS2 of the trim controller. The corresponding proportionate parameter of the trim controller can also, just like a corresponding integral parameter of the trim controller, for example be specified as a function of the rotational speed, and/or the load variable LOAD.

During the diagnostic operating state of a component assigned to the exhaust gas tract, the proportionate corrective factor P_COR_TRIM is applied to block B7. This means that during the diagnosis the lambda control factor LAM_FAC is in addition determined depending on the proportionate corrective factor P_COR_TRIM. The result is that a control difference DMS2 of the trim controller occurring acts in an exceedingly timely manner in adapting the lambda control factor LAM_FAC and consequently the control signal for dispensing the fuel. In this way, it is also possible that during the diagnosis, changes identified in the response behavior of the first exhaust gas probe 42 have to be compensated for in a very timely manner. This is especially important during the diagnosis, because as a result of the extended delay time duration T_D when compared to an operating condition which is not within the limits of a diagnostic operating state, an intervention by the trim controller can only after a clear delay and hence an unstable control behavior can possibly occur because of high dead time. This is intensified all the more because during the diagnosis, a fluctuation in the oxygen load of the exhaust gas catalytic converter is particularly pronounced.

Outside the diagnostic operating state the proportionate corrective factor P_COR_TRIM of the delay time duration T_D can be inserted instead of being fed directly into block B7.

During the diagnostic operating state, the lambda correction factor LAM_COR and the proportionate corrective factor P_COR_TRIM can be logically linked to the lambda control factor LAM_FAC by adding or by multiplying and, if required, by weighting. Moreover, the proportionate corrective factor can also be used in the diagnostic operating state alternatively or additionally so as to determine the amount of fuel MFF to be dispensed in block B9 or also to determine the control signal in block B11. Thus for example, depending on the proportionate corrective factor P_COR_TRIM, an injection time duration of the specific injection valve 18 can be modified.

However, the reference MS2_REF can for example be predetermined, but is preferably specified differently for the diagnostic operating state by comparison with operating which are outside diagnosis. The reference MS2_REF is for example the corresponding rich value or the corresponding lean value or in particular also a suitably specified intermediate value in a diagnostic operating state, which can for example be determined by observing the actual value MS2 of the second measurement signal during previous diagnoses.

Above and beyond this, the delay time duration T_D, the proportionate jump P_J, the integral increment I_INC, the diagnosis proportionate jump factor DELTA_P, the diagnosis delay time duration factor T_D_DIAG, the trim delay time duration factor T_D_COR_TRIM, the adaptation delay time duration factor T_D_AD and, if required, also the proportionate corrective factor P_COR_TRIM can be determined differently for the lean periods or the rich periods of the lambda controller.

However, outside the diagnostic operating state, the control difference DMS2 of the trim controller can for example also be formed without having to filter the actual value MS2 of the second measurement signal.

The invention claimed is:

1. A device to operate an internal combustion engine, wherein the internal combustion engine has a cylinder, and an exhaust gas tract with an exhaust gas catalytic converter, a first exhaust gas probe arranged upstream of the exhaust gas catalytic converter and a second exhaust gas probe arranged downstream of the exhaust gas catalytic converter, comprising:

a lambda controller to determine a lambda correction factor based upon a first measurement signal assigned to the first exhaust gas probe;

a trim controller to determine a proportionate corrective factor, wherein a setpoint value and an actual value of a second measurement signal assigned to the second exhaust gas probe are provided as a control difference for the trim controller; and a control signal unit to determine a control signal for apportioning fuel into the cylinder based upon the lambda correction factor and to determine the control signal also based upon the proportionate corrective factor in a diagnostic operating state of a component assigned to the exhaust gas tract.

2. The device as claimed in claim 1, wherein a low-pass filter filters the actual value of the second measurement signal, wherein in the diagnostic operating state the filtered actual value is feed to the trim controller to determine the control difference.

3. The device as claimed in claim 1, wherein the diagnostic operating state is a diagnostic operating state of the exhaust gas catalytic converter.

4. The device as claimed in claim 2, wherein the diagnostic operating state is a diagnostic operating state of the exhaust gas catalytic converter.

5. The device as claimed in claim 1, wherein the first exhaust gas probe is a binary lambda probe.

6. The device as claimed in claim 1, wherein the actual value of the second measurement signal is filtered based upon a moving average.

7. The device as claimed in claim 6, wherein a new actual value of the second measurement signal is weighted with essentially 10% and an old filtered actual value is weighted with essentially 90%.

8. The device as claimed in claim 1, wherein the lambda controller is loaded with a diagnosis delay time duration factor and a diagnosis proportionate jump factor to determine a oxygen storage capability of the exhaust gas catalytic converter.

9. The device as claimed in claim 8, wherein it is determined based upon the oxygen storage capability whether the exhaust gas catalytic converter is an aged exhaust gas catalytic converter.

10. A device to operate an internal combustion engine, wherein the internal combustion engine has a cylinder, and an exhaust gas tract with an exhaust gas catalytic converter, a first exhaust gas probe arranged upstream of the exhaust gas catalytic converter and a second exhaust gas probe arranged downstream of the exhaust gas catalytic converter, comprising:

a lambda controller to determine a lambda correction factor based upon a first measurement signal assigned to the first exhaust gas probe;

a trim controller to determine a proportional corrective factor, wherein a setpoint value and an actual value of a second measurement signal assigned to the second exhaust gas probe are provided as a control difference for the trim controller; and a control signal unit to determine a control signal for apportioning fuel into the cylinder base upon the proportional corrective factor in a diagnostic operating state of a component assigned to the exhaust gas tract.

11. The device as claimed in claim 10, wherein the component assigned to the exhaust gas tract is the exhaust gas catalytic converter.

12. The device as claimed in claim 11, wherein the control signal is additional based upon the lambda correction factor.

13. The device as claimed in claim 10, wherein a low-pass filter filters the actual value of the second measurement signal, and wherein in the diagnostic operating state the filtered actual value is feed to the trim controller to determine the control difference.

14. The device as claimed in claim 10, wherein the first exhaust gas probe and the second exhaust probe are a binary lambda probe.

15. The device as claimed in claim 10, wherein the lambda controller is a two-point controller.

16. The device as claimed in claim 10, wherein the lambda controller is a PI controller, having a P part and an I part.

17. The device as claimed in claim 16, wherein the PI controller has an assigned performance graph for at least on of the two parts.

18. A device to operate an internal combustion engine, wherein the internal combustion engine has a cylinder, and an exhaust gas tract with an exhaust gas catalytic converter, a first exhaust gas probe arranged upstream of the exhaust gas catalytic converter and a second exhaust gas probe arranged downstream of the exhaust gas catalytic converter, comprising:

a lambda controller to determine a lambda correction factor based upon a first measurement signal assigned to the first exhaust gas probe, and wherein the lambda controller is loaded with the diagnosis delay time duration factor and the diagnosis proportionate jump factor to check the oxygen storage capability of the exhaust gas catalytic converter;

a trim controller to determine a proportionate corrective factor, wherein a setpoint value and an actual value of a second measurement signal assigned to the second exhaust gas probe are provided as a control difference for the trim controller; and a control signal unit to determine a control signal for apportioning fuel into the cylinder based upon the lambda correction factor.

19. The device as claimed in claim 18, wherein the control signal is determined based upon the proportionate corrective factor in a diagnostic operating state of a exhaust gas catalytic converter.

20. The device as claimed in claim 19, wherein it is determined whether the exhaust gas catalytic converter is an aged exhaust gas catalytic converter based upon the oxygen storage capability.

* * * * *